US005711221A

United States Patent [19]

Compera et al.

[11] Patent Number: 5,711,221

[45] Date of Patent: Jan. 27, 1998

[54] TRANSFER CYLINDER WITH ELECTROMOTIVE DRIVE UNIT

[75] Inventors: Christian Compera, Dossenheim; Martin Greive, Heidelberg; Bernd Herrmann, Malsch; Karlheinz Peter, Gernsheim; Anton Rodi, Leimen, all of Germany

[73] Assignee: Heidelberger Druckmaschinen AG, Heidelberg, Germany

[21] Appl. No.: 632,085

[22] Filed: Apr. 15, 1996

[30] Foreign Application Priority Data

Apr. 15, 1995 [DE] Germany ..... 195 14 157.1
Aug. 17, 1995 [DE] Germany ..... 195 30 283.4

[51] Int. Cl.[6] ..... B41F 13/10

[52] U.S. Cl. ..... 101/375; 101/216; 310/67 R; 492/15

[58] Field of Search ..... 101/375, 216, 101/212, 348, 141; 318/696; 310/67 R, 68 B; 492/12, 15

[56] References Cited

U.S. PATENT DOCUMENTS

| | | | |
|---|---|---|---|
| 3,608,486 | 9/1971 | McDonald et al. | 101/365 |
| 4,665,350 | 5/1987 | Angi et al. | 318/696 |
| 4,930,415 | 6/1990 | Hara et al. | 101/425 |
| 5,524,805 | 6/1996 | Shiba et al. | 101/425 |

FOREIGN PATENT DOCUMENTS

| | | |
|---|---|---|
| 0 699 524 A2 | 3/1996 | European Pat. Off. . |
| 93 06 369.5 | 12/1993 | Germany . |

*Primary Examiner*—Eugene H. Eickholt
*Attorney, Agent, or Firm*—Herbert L. Lerner; Laurence A. Greenberg

[57] ABSTRACT

Transfer cylinder with an electromotive drive unit includes a common bearing for a rotor of the electromotive drive unit and for the transfer cylinder, the bearing being disposed in a unit of a printing press supporting the drive unit and the transfer cylinder.

9 Claims, 4 Drawing Sheets

TRANSFER CYLINDER WITH ELECTROMOTIVE DRIVE UNIT

BACKGROUND OF THE INVENTION

FIELD OF THE INVENTION

The invention relates to a transfer cylinder for printing presses and an electromotive drive unit therefor.

It has become known heretofore for a transfer cylinder of a printing press, for example, an impression cylinder, to be driven by a motor installed at some other point in the printing press and connected to the transfer cylinder via force transmitting elements, such as a gear transmission. In such an arrangement, the transfer cylinder, the motor and, if necessary or desirable, the gear transmission, respectively, have their own bearings in one or more units of the printing press which support them, such as the side walls, for example.

SUMMARY OF THE INVENTION

It is accordingly an object of the invention to provide a transfer cylinder with an electromotive drive unit which is particularly simple mechanically and largely play-free.

With the foregoing and other objects in view, there is provided, in accordance with the invention, a transfer cylinder with an electromotive drive unit, comprising a common bearing for a rotor of the electromotive drive unit and for the transfer cylinder, the bearing being disposed in a unit of a printing press supporting the drive unit and the transfer cylinder.

In accordance with another feature of the invention, the transfer cylinder has a shaft, and the electromotive drive unit is an internal rotor armature, the rotor being disposed on an axial end of the transfer cylinder and on the shaft of the transfer cylinder.

In accordance with a further feature of the invention, the transfer cylinder has an elongated journal pin, the rotor is formed by the elongated journal pin, and a plurality of magnets are secured on the outside of the elongated journal pin.

In accordance with an added feature of the invention, the electromotive drive unit is an external rotor armature, the rotor is formed by a hollow part of the transfer cylinder, and a plurality of magnets are secured on the inside of the hollow part of the transfer cylinder.

In accordance with an additional feature of the invention, the electromotive drive unit is a synchronized motor having a rotor, the rotor being provided with permanent magnets.

In accordance with yet another feature of the invention, the electromotive drive unit is formed of the rotor and a part firmly joinable to a printing press, and a stator and a sensor are included for scanning the position of the transfer cylinder, the stator and the sensor being integrated in the part.

In accordance with yet a further feature of the invention, the transfer cylinder includes at least one of an open and closed-loop control electronics system and a power electronics system for the electromotive drive unit also integrated in the part firmly joinable to the printing press.

In accordance with yet an added feature of the invention, the transfer cylinder is formed with a work surface, and a respective bearing surface is formed at each of the axial ends thereof, the transfer cylinder being formed as an open tube at least at an end thereof at which the electromotive unit is located, the open tube having an outside forming both the work surface of the transfer cylinder and also one of the bearing surfaces, the work surface and the one bearing surface being of continuous construction and having the same diameter.

In accordance with a concomitant feature of the invention, the outer surface of the transfer cylinder is formed so as to accommodate one of a direct bearing between roller bodies of a roller bearing, and a slide bearing.

Because the rotor of the electromotive drive unit is supported together with the transfer cylinder in a common bearing, and the appertaining stator is joinable firmly to the printing press, a separate support for the drive unit is unnecessary. Moreover, at no point are there any force transmitting elements which are subjected to play. The elimination of bearings, force transmitting elements and the corresponding retaining devices makes for especially economical production.

Direct drives are indeed known per se, for example, for record players. However, driving the cylinders of printing presses in a similar way has never been considered heretofore, because not only must the synchronized travel of a single cylinder be assured, but all the cylinders must always be synchronized exactly with one another, and this must be done in the presence of considerable driving and load-varying forces. As has been demonstrated, these demands can be met, in the realization of the invention, by a suitable choice of motor type and by using a suitable electronic open and closed-loop control device.

A first motor type suitable for the invention is an internal rotor armature having a rotor which is disposed at an axial end of the transfer cylinder and on the shaft of the transfer cylinder; for example, the journal of the transfer cylinder is elongated or lengthened past the appertaining cylinder bearing and is provided on the outside thereof with an arrangement of magnets. A cup-shaped stator which is secured to the printing press radially surrounds the rotor.

As mentioned hereinbefore, an additional bearing of the rotor can be dispensed with or omitted. The prerequisite for this, however, is adequately high resistance to deflection on the part of the journal or journal pin, to avoid collisions of the rotor and stator caused by shaft impact.

A second suitable type of motor is an external rotor armature type having a rotor formed by a part of the transfer cylinder and having magnets secured on the inside thereof. As a result, such rigidity exists from the very outset that no collision between the rotor and stator is possible.

The stringent demands for synchronized operation of the drive are met best by a slow-speed, permanently excited synchronized motor having concentricity properties which are optimized, for example, by inclined slotting, sinusoidal magnetization in the air gap, and an adequately high number of poles.

For controlling synchronization, the angular position of the transfer cylinder must be detected continually. A sensor scanning suitable markings on the rotor or on the transfer cylinder is preferably integrated with the stator at a fixed installation position. Because the position transducer formed by the markings and the sensor is located at the same end of the transfer cylinder as the rotor, practically no errors in measuring the rotary angle occur. Due to the great stiffness or rigidity of the structure-, excellent closed-loop control properties are attained.

The structural unit having the stator is mountable as a whole on the printing press and removable again therefrom without adjustment effort.

This structural unit may additionally contain closed and open-loop control electronics and/or power electronics for the electromotive drive unit, so that it forms an autonomous drive unit with local intelligence.

The transfer cylinder of the essential drive components thus include only two structural units, first an integral unit formed of the transfer cylinder and the rotor, and second a stator unit with integrated electronics, which makes the printing press relatively easy to repair and maintain.

The drive according to the invention is very sturdy and, in comparison with heretofore known transfer cylinder drives, has a lower weight and a smaller structural volume.

In the case wherein the motor is of the external rotor armature type, a conventional cylinder bearing with journals or journal pins flanged to the transfer cylinder cannot be used at the side of the motor. For such a case, the invention provides that the transfer cylinder, at least at the end with the motor, takes the form of an open tube, the outside of which forms not only the work surface of the transfer cylinder but also a bearing surface; the work surface and the bearing surface are of continuous construction and have the same diameter.

The rotor magnets are secured on the inside of the open end of the transfer cylinder. In addition, any additional devices necessary for printing technology can be accommodated inside the transfer cylinder.

Such a transfer cylinder can also be removed from the printing press laterally, without having the remove the bearings or the side walls.

When both ends of the transfer cylinder are formed as an open tube, the transfer cylinder can then also be made from a tubular semifinished product, without expensive welding and without extensive metal-cutting or machining. No sagging of the journal or deformation of flanges occurs as in conventional transfer cylinders, and the transfer cylinder has the greatest possible stiffness or rigidity for a given weight.

Such a construction is particularly suitable for transfer cylinders with a continuous work surface, which lack any longitudinal groove, slot or gap. Such transfer cylinders may be provided with a hard, wear-resistant, high-precision surface, in order to lend the work surface of the transfer cylinder certain properties which are significant from the standpoint of printing technology, primarily. If the entire outer surface of a transfer cylinder of the invention is constructed in this manner, the aforementioned properties are then also advantageous for the bearing of the transfer cylinder. In particular, it becomes possible to use the hard surface simultaneously as a bearing surface, and to support the printing roller directly on the roller bodies of a roller bearing or in a slide bearing.

A tubular embodiment of the transfer cylinder can be considered not only for an external rotor armature but also for an internal rotor armature. In the latter case, the rotor is preferably embodied as a substantially cylindrical component which protrudes laterally from the transfer cylinder and is radially encompassed by a cup-shaped stator.

Other features which are considered as characteristic for the invention are set forth in the appended claims.

Although the invention is illustrated and described herein as embodied in a transfer cylinder with an electromotive drive unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
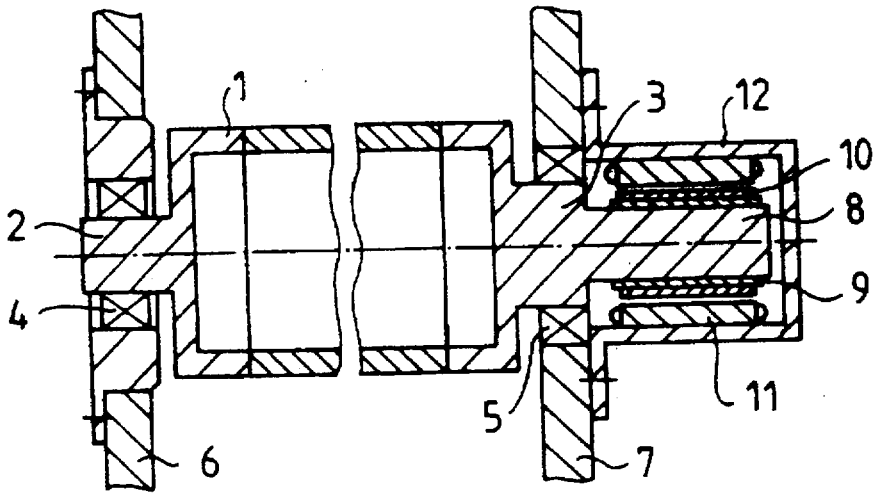
FIG. 1 is an axial cross-sectional view of a basic structure of a transfer cylinder with an integrated internal rotor armature.

Referring now to the drawings and, first, particularly to FIG. 1 thereof, there is shown therein a transfer cylinder 1 having a respective journal or journal pin 2, 3 at each end thereof, the journal pins 2 and 3, respectively, being supported via ball bearings 4, 5 in side walls 6, 7 of a printing press.

The journal pin 3 is elongated outwardly past the ball bearing 5. A cylindrical sleeve 9, on the outside of which premounted permanent magnets 10 are disposed, is pressed force-lockingly onto the elongated part 8 of the journal pin 3. In this regard, it is noted that a force-locking connection is one which connects two elements together by force external to the elements, as opposed to a form-locking connection which is provided by the shapes of the elements themselves.

The rotor formed in this way is surrounded concentrically by a stator formed by electromagnets 11 which are secured on the cylindrical inside of a cup-shaped stator housing 12, which is secured at an open side thereof to the side wall 7 of the printing press.

Figure 2:
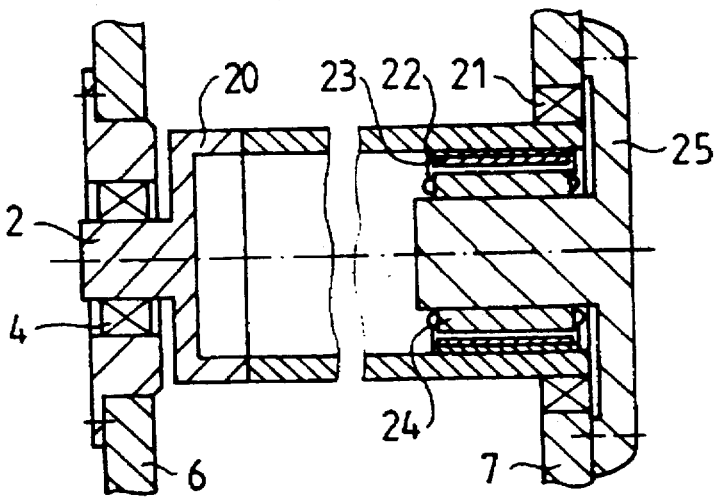
FIG. 2 is a view like that of FIG. 1 of a basic structure of a transfer cylinder with an integrated external rotor armature.

In FIG. 2 wherein elements largely matching those of the exemplary embodiment of FIG. 1 are identified by the same reference numerals, a transfer cylinder 20 is formed at one end, as in FIG. 1. At the other end thereof, the transfer cylinder 20 has no journal pin but instead is constructed as an open tube supported in a ball bearing 21 having a diameter matching the diameter of the tube, the ball bearing 21 being supported in the side wall 7 of the printing press. A cylindrical sleeve 22, on the inside of which premounted permanent magnets 23 are disposed, is pressed force-lockingly into the open end of the transfer cylinder 20. The transfer cylinder 20 to be driven serves, in this embodiment, in combination with the sleeve 22 and the permanent magnets 23, as the rotor.

The appertaining stator is formed by electromagnets 24, which are secured to the outside of a journal-like part of a stator housing 25. The stator housing 25 is secured to the side wall 7 of the printing press in a way that the journal-like part having the electromagnets 24 dips concentrically into the arrangement of permanent magnets 23.

Figure 3:
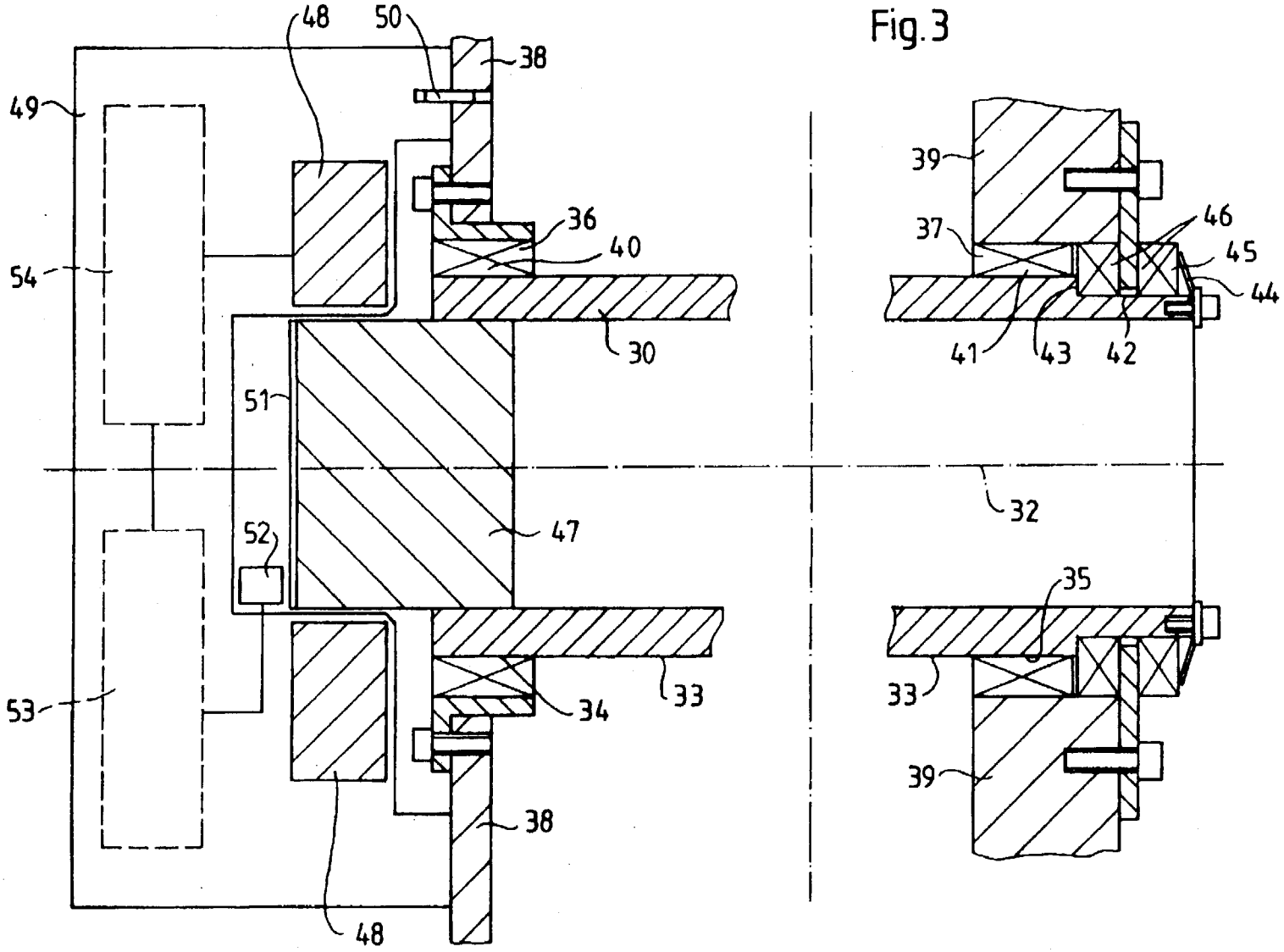
FIG. 3 is another view like that of FIG. 1 of a tubular transfer cylinder with an integrated internal rotor armature.

FIG. 3 shows a transfer cylinder 30 in the form of a continuous straight tube, which extends along an axis 32. The outer surface of the transfer cylinder 30 is an extremely hard, wear-resistant and high-precision ceramic surface which, with the same diameter throughout, forms both an axially middle cylindrical work surface 33 as well as bearing surfaces 34 on the axial ends of the transfer cylinder 30. In other words, the work surface 33 and the bearing surfaces 34 and 35 together form one continuous surface with the same diameter throughout.

The bearing surfaces 34 and 35 are supported, for axial rotatability of the transfer cylinder 30, in radial bearings 36 and 37, which are secured to side walls 38 and 39 of the printing press. The bearing surfaces 34 and 35 run directly on roller bodies 40 and 41, respectively, of the radial bearings 36, 37.

Adjacent to the bearing surface 35 and entirely at one axial end, the transfer cylinder 30 has an annular axial bearing surface 42 with a somewhat smaller diameter than the bearing surface 35. Between a shoulder 43 on the transfer cylinder 30, formed by a reduction in diameter, and an annular cup spring 44 screwed onto the end thereof, an axial bearing 45 is seated on the axial bearing surface 42. The axial bearing 45 contains roller bodies 46, which axially guide the transfer cylinder 30 and, like the radial -bearing 37, is secured to the side wall 39.

The transfer cylinder 30 shown in FIG. 3 can be removed very simply by being pulled laterally out of the printing press after the axial bearing 45 has been loosened. While the transfer cylinder 30 can be removed to both sides, in the exemplary embodiment shown, because the work surface 33 and the bearing surfaces 34 and 35 have the same diameter, embodiments are also possible wherein, for example, the diameter of the bearing surface 34 is somewhat greater or the diameter of the bearing surface 35 somewhat smaller than the diameter of the work surface 33, so that the transfer cylinder 30 can be removed to at least one side. On the other hand, a tube with an essentially uniform surface, as shown in FIG. 1, is naturally the easiest to make.

A cylindrical rotor 47 is press-fitted concentrically into one end of the transfer cylinder 30; it contains permanent magnets, not shown in detail, and protrudes past the end of the transfer cylinder 30. The protruding part of the rotor 47 is radially surrounded by electromagnets 48, which are permanently mounted in a stator housing 49. The stator housing 49 is secured to the side wall 38 of the printing press, for example, by means of a non-illustrated clamping device pressing the stator housing 49 against the side wall 38, with the stator housing 49 being axially fixed with pins 50. This makes for easy mounting and removal of the stator housing 49.

A marking disk 51 is secured to the outer axial end of the rotor 47. The stator housing 49 contains one or more sensors 52, which are disposed adjacent to the marking disk 51, with an air gap therebetween. The marking disk 51 and the sensor or sensors 52 form a position transducer for the angular position of the rotor 47 or of the transfer cylinder 30. The position transducer has a resolution of 1000 periods per revolution or more, depending upon the particular demands for synchronization.

Also accommodated in the stator housing 49, as shown diagrammatically, are open and closed-loop control electronics 53 and power electronics 54. The power electronics 54 are connected, via non-illustrated power supply lines, to a power supply at the printing press, and supplies current to the electromagnets 48 as a function of control signals of the open and closed-loop control electronics 53. The open and closed-loop control electronics 53, together with the power electronics 54, the motor, and the position transducer with the sensor or sensors 52 to which they are connected, form a closed control loop for controlling the synchronization of the transfer cylinder 30. For synchronization with additional transfer cylinders or for controlling and monitoring the rotation of the cylinders, the open and closed-loop control electronics 53 are connected to a printing-press computer.

Figure 4:
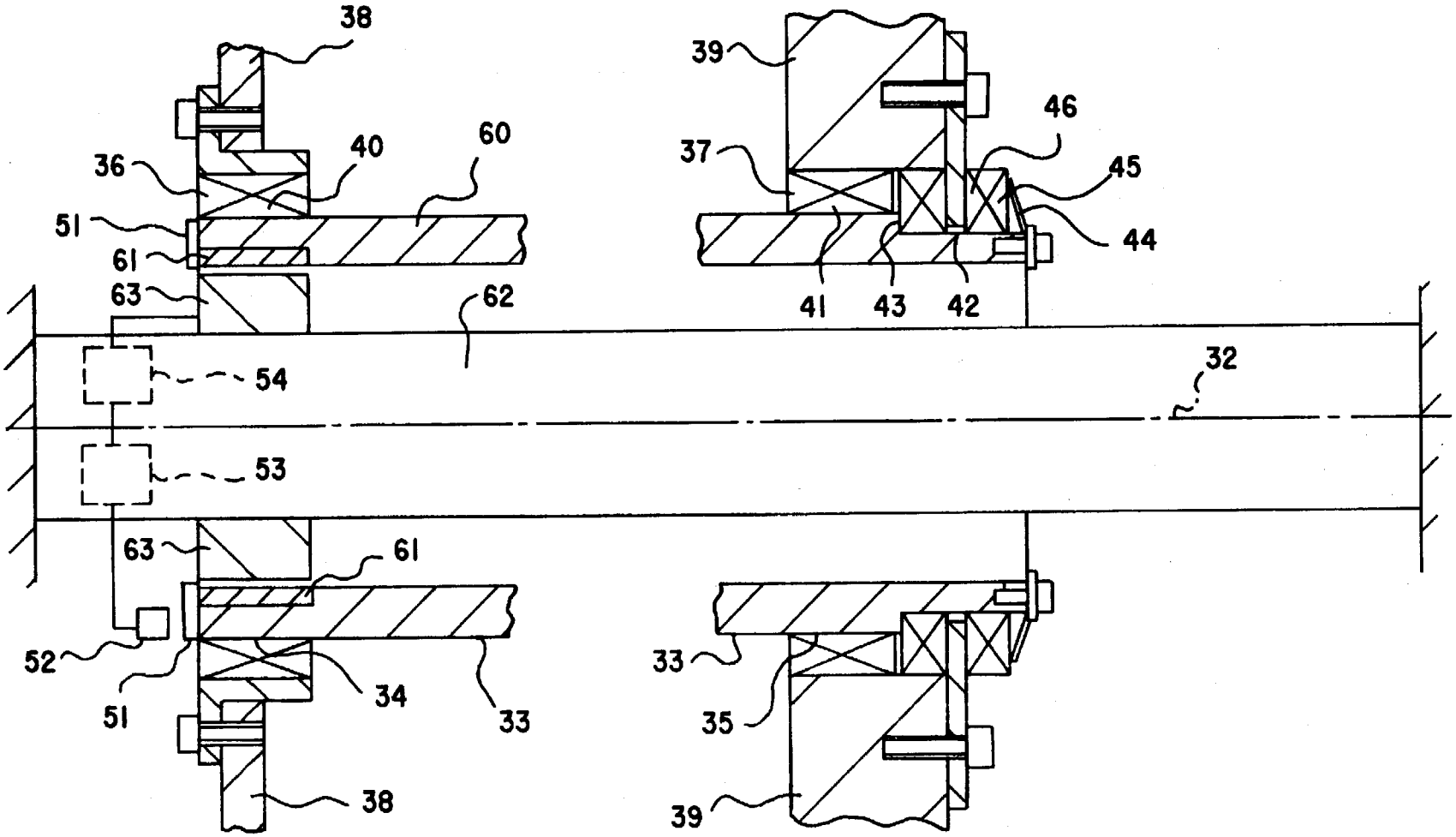
FIG. 4 is a further view like that of FIG. 1 of a tubular transfer cylinder with an integrated external rotor armature.

FIG. 4 is an exemplary embodiment of a tubular transfer cylinder with an integrated external rotor armature. Elements which match those of the exemplary embodiment of FIG. 3 are identified by the same reference numerals.

In FIG. 4, in a transfer cylinder 60 which otherwise matches the transfer cylinder 30 of FIG. 1, a number of magnets 61 are machined or otherwise embedded into the inside thereof at one axial end. Located in the interior of the transfer cylinder 60 is a stator shaft 62 carrying magnet coils 63 which are located opposite the magnets 61. The stator shaft 62 extends through the entire transfer cylinder 60 and is secured to the printing press at both ends, as diagrammatically shown. The result is an especially high rigidity of the stator.

As in the exemplary embodiment of FIG. 3, a position transducer, open and closed-loop control electronics and power electronics can be integrated with the stator in the exemplary embodiments of FIGS. 1, 2 and 4, as well.

It is also possible to drive a transfer cylinder from both sides, by providing both ends of the transfer cylinder with drives of the type shown and described.

Figure 5A:
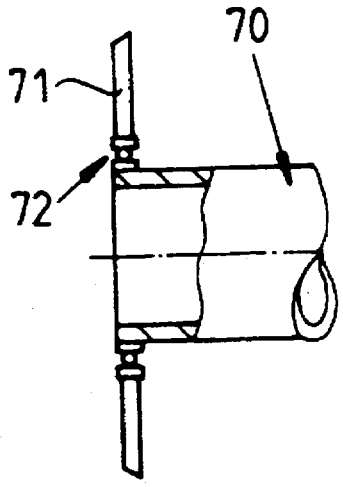
FIGS. 5*a* to 5*d* are axial views partly broken away and in section of various types of cylinder bearings useable with the tubular transfer cylinders.
Figure 5B:
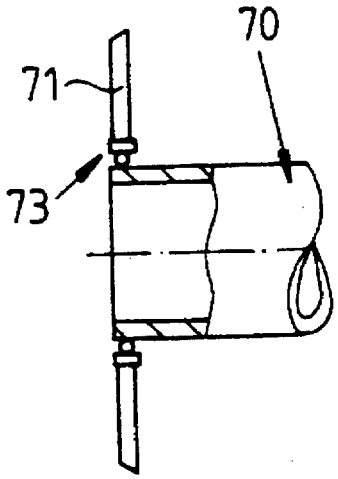

FIGS. 5*a* to 5*d* show several alternatives for supporting a tubular transfer cylinder 70 in a side wall 71. The use of a roller bearing 72 with an inner and outer race, as shown in FIG. 5*a*, is advantageous if the bearing face of the transfer cylinder cannot or should not be stressed directly. Instead of the needle bearing shown in FIG. 3 or FIG. 4, ball bearings can be used as the roller bearings, as shown in FIGS. 5*a* and 5*b*. The balls of a ball bearing can also roll directly along the bearing surface of the transfer cylinder 70, as shown in FIG. 5*b* for a roller bearing 73 without an inner race.

Figure 5C:
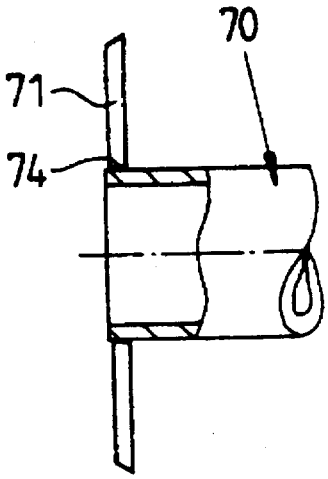
Figure 5D:
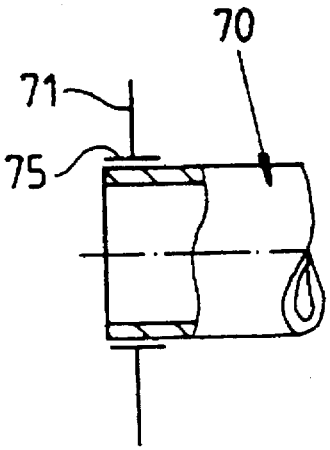

As suggested in FIG. 5*c* without details, roller bodies can also roll directly, without the interposition of bearing races, along both the transfer cylinder 70 and a bearing surface 74 formed in the side wall 71. Finally, the roller bodies may also be omitted, if a slide bearing of the transfer cylinder 70 in a bearing bushing 75 is used, as shown in FIG. 5*d*.

We claim:

1. Transfer cylinder with an electromotive drive unit, comprising;

a common bearing for a rotor of an electromotive drive unit and for a transfer cylinder, said bearing being disposed in a unit of a printing press supporting the electromotive drive unit and the transfer cylinder; and the transfer cylinder having a work surface, axial ends, and bearing surfaces at each of said axial ends of the transfer cylinder, the transfer cylinder being formed as an open tube at least at one of said axial ends thereof at which the electromotive drive unit is located, said open tube an outside forming said work surface of the transfer cylinder and also said one of said bearing surfaces, said work surface and said one of said bearing surfaces being of continuous construction and having a same diameter.

2. Transfer cylinder according to claim 1, wherein the transfer cylinder has a shaft, and wherein the electromotive drive unit is an internal rotor armature, the rotor being disposed on an axial end of the transfer cylinder and on said shaft of the transfer cylinder.

3. Transfer cylinder according to claim 2, wherein the transfer cylinder has an elongated journal pin, and wherein the rotor is formed by said elongated journal pin, and including a plurality of magnets secured on the outside of said elongated journal pin.

4. Transfer cylinder according to claim 1, wherein the electromotive drive unit is a rotor armature and a stator, and said rotor is formed by a hollow part of the transfer cylinder and surrounds said stator, and including a plurality of magnets secured on an inside of said hollow part of the transfer cylinder.

5. Transfer cylinder according to claim 1, wherein the electromotive drive unit is a synchronized motor having a rotor, said rotor being provided with permanent magnets.

6. Transfer cylinder according to claim 1, wherein the electromotive drive unit is formed of a rotor and a part firmly joinable to the printing press, and including a stator and a sensor for scanning a position of the transfer cylinder, said stator being integrated in said part.

7. Transfer cylinder according to claim 6, including at least one of an open and closed-loop control electronics system and a power electronics system for the electromotive drive unit also integrated in said part firmly joinable to the printing press.

8. Transfer cylinder according to claim 1, wherein an outer surface of the transfer cylinder is formed so as to accommodate a direct bearing between roller bodies of a roller bearing.

9. Transfer cylinder according to claim 1, wherein the outer surface of the transfer cylinder is formed so as to accommodate a slide bearing.

* * * * *